US005245848A

United States Patent [19]

Lee, Jr. et al.

[11] Patent Number: 5,245,848

[45] Date of Patent: Sep. 21, 1993

[54] SPIN FLOW NECKING CAM RING

[75] Inventors: Harry W. Lee, Jr., Chesterfield County; H. Alan Myrick, Richmond, both of Va.

[73] Assignee: Reynolds Metals Company, Richmond, Va.

[21] Appl. No.: 929,933

[22] Filed: Aug. 14, 1992

[51] Int. Cl.[5] ..... B21D 19/12

[52] U.S. Cl. ..... 72/84; 72/110

[58] Field of Search ..... 72/84, 105, 106, 110

[56] References Cited

U.S. PATENT DOCUMENTS 1,356,980 10/1920 Gray .
3,227,070 1/1966 Brigham et al. .
3,266,451 8/1966 Kraus .
3,283,551 11/1966 Kraft et al. .
3,469,428 9/1969 Aschberger .
3,613,571 10/1971 Russell et al. .
3,688,538 9/1972 Hoyne .
3,754,424 8/1973 Costanzo .
4,023,250 5/1977 Sproul et al. .
4,058,998 11/1977 Franek et al. .
4,070,880 1/1978 Gombas .
4,170,888 10/1979 Golata .
4,341,103 7/1982 Escallon et al. .
4,391,511 7/1983 Akiyama et al. .
4,606,207 8/1986 Slade .
4,838,064 6/1989 Pass .
4,870,847 10/1989 Kitt .

*Primary Examiner*—Lowell A. Larson
*Attorney, Agent, or Firm*—Robert C. Lyne, Jr.

[57] ABSTRACT

A method and apparatus for spin flow necking-in a D&I can is disclosed wherein an externally located free spinning form roll is moved radially inward and axially against the outside wall of the open end of a trimmed can. A spring-loaded interior support slide roll moves under the forming force of the form roll as the latter slides along a conical forming surface of a second free roll mounted axially inwardly adjacent the slide roll. To prevent damage to the metal caused by excessive pressure contact between the form and slide rolls, the slide roll is axially retracted via a cam ring which initially contacts the form roll during radially inward necking movement.

12 Claims, 7 Drawing Sheets

SPIN FLOW NECKING CAM RING

TECHNICAL FIELD

The present invention relates generally to apparatus and methods for necking-in container bodies preferably in the form of a cylindrical one-piece metal can having an open end terminating in an outwardly directed peripheral flange merging with a circumferentially extending neck and, more particularly, to an improved spin flow necking process and apparatus.

BACKGROUND ART

When two-piece aluminum draw and iron (D&I) beverage cans were first made in the mid-1960's, the cans were quite different from today's cans. Not only were the cans 70% heavier, the shape was also different. Since the aluminum can was competing against the three-piece steel can which it would eventually supplant, it necessarily had the same shape. The size of the 12-ounce beverage can in the mid-1960's was 211×413. Therefore, the can body was not necked prior to a flanging operation in which an outwardly extending peripheral flange was formed at one end of the can body to receive, and be seamed to, a can end after filling with beverage.

The 211 diameter configuration (can-maker's terminology referring to a diameter of 2 11/16") caused two major problems in the two-piece aluminum D&I can. The first problem was split flanges. Specifically, in the flanging operation, the metal was expanded from the 2.6" body diameter to a 2.8" flange diameter, i.e., a 7.7% increase. This obviously create circumferential tension in the flange which resulted in a tendency for it to split. Split flanges resulted in leakage from the can seams which was a major problem. The second problem related to conveying the flanged cans. When adjacent cans were allowed to touch, flange damage would occur and conveying jams were frequent because of the way the cans would tilt when in flange-to-flange contact which created clearance between the can bodies.

Although many improvements were made to lessen the adverse impacts of the foregoing problems, the solution which emerged in the mid-1960's was the necking process Necking reduced the diameter of the open end of the can prior to flanging which allowed a smaller end (e.g., a 209 end which is 2 9/16" diameter in can-maker's terminology) to be used. The resulting configuration greatly reduced the tendency for split flanges since the flange diameter in the necked can is only 2.3% greater than the body diameter. Necking also made conveying the cans easier since, with only slight flange overlap, the cans would contact body-to-body. Seamed 209 cans could contact body-to-body without tilting.

The necking process was instrumental in the subsequent success of the two-piece D&I beverage can. In the decade following the introduction of the 209 necked can, the three-piece steel can virtually disappeared from the can beverage market.

In the late 1970's, the necking process was revisited as a means of achieving further lightweighting and reduced costs. If the cans were necked to a smaller diameter, then a smaller, lighter, less expensive can end could be used. During the following years, the industry moved from the 209 neck to a 206 neck. By the mid- 1980's, most commercial can-makers considered the 206 can to be industry standard.

Three different necking processes were used to produce the 206 aluminum can. In one process, a four-stage die necking procedure resulted in each successively formed neck reducing the diameter by about 0.085". In this process, four distinct necks are formed on the can. This process is called "quad-neck." Another process is a six-stage die necking process whereby each step reduces the diameter about 0.055" and the necks blend together in a continuous profile. This process is called "smooth die neck." The third type of necking process is a combination of either two or three die necks followed by a spin necking operation. Each of the die necking operations reduces the diameter by about 0.075–0.110" and the spin necking operation reduces it by 0.110". The spin necking process smooths all but the first die neck which leaves one obvious neck that blends into a continuous profile. This process is called "spin necking."

A renewed interest in cost competitiveness has resulted in the production of even smaller diameter can ends. As can-makers ponder the possibility of a 204 can end and smaller necks, they necessarily revisited the can design criteria. First and foremost, the capacity of the can must be maintained without changing the can height or diameter. This means that as the neck diameter decreases, the neck angle would ideally become greater so as to maintain the neck shoulder location and not encroach upon the volume of the can. A side benefit of a steeper neck angle is reduced metal usage. Can-makers typically employed thicker metal in the neck area of the can to facilitate necking and flanging. Therefore, a steeper, shorter neck means reduced length for the thicker metal which results in the reduced metal usage. A third advantage of a steeper neck is increased billboard, i.e., the cylindrical portion of the can available for customer graphics.

An additional consideration in the selection of a necking process is the diameter reduction capability for each step. The greater the reduction, the fewer steps are needed, thereby reducing costs and streamlining the process. Aesthetics is also a consideration. Finally, ease of manufacturing is a factor which must be considered in selecting a necking process. Any other advantages can be lost if productivity in the necking tooling is diminished because of a more critical necking process.

The foregoing considerations led to the development of a process now known in the industry as "spin flow necking." A particularly promising spin flow process and apparatus are disclosed in U.S. Pat. No. 4,781,047, issued Nov. 1, 1988, to Bressan et al, which is assigned to Ball Corporation and is exclusively licensed to the assignee of the present application, Reynolds Metals Company. The disclosure of this patent is hereby incorporated by reference herein in its entirety. It concerns a process where an externally located free spinning forming roll 11 is moved inward and axially against the outside wall C' of the open end C" of a rotating trimmed can C to form a conical neck at the open end thereof. With reference to FIG. 1, a spring-loaded holder or slide roll 19 supports the interior wall of the can C and moves axially under the forming force of the free roll 11. This is a single operation where the can rotates and the free roll 11 rotates so that a smooth conical necked end is produced. In practice, the can is then flanged. The term "spin flow necking" is used in this application to refer to such processes and apparatus, the essential difference between spin flow necking and other types of spin necking being the axial movement of both the external roll 11 and the internal support 19.

More specifically, the spin flow tooling assembly 10 depicted in FIG. 1 (corresponding to FIG. 1 of the Bressan et al '047 patent, supra) includes a necking spindle shaft 16*a* rotatable about its axis of the rotation A by means of a spindle gear 16 mounted to the shaft between front and rear bearings (not shown). The slide roll 19 is mounted to the front end of the necking spindle shaft 16*a* through a slide mechanism 28, keyed to the shaft, which permits co-rotation of the roll 19 while allowing it to be slid by the necking forces described more fully below in the axially rearward direction B' away from the eccentric freewheeling roll 24 located adjacent the front face of the slide roll. The axially fixed idler roll 24, having an axis of rotation B which is parallel to and rotatable about spindle axis A, is mounted via bearings 16*b* and 23 to an eccentrically formed front end of an eccentric roll support shaft 18. This shaft 18 extends through the necking spindle shaft 16*a*. The spindle shaft 16 is rotated by the spindle gear 16 without rotating the eccentric roll support shaft 18.

The outer forming roll 11 is mounted radially outwardly adjacent the slide and eccentric rolls 19,24.

The container slide roll 19 is shaped with a conical leading edge 19*a* designed to first engage the open end C" of the container C to support same for rotation about spindle axis A under the driving action of the necking spindle gear 16 which may be driven by the same drive mechanism driving each base pad assembly 29 engaging the container bottom wall. Slide roll 19 is also free to slide axially but is resiliently biased into the container open end C" via springs 20 which may be of the compression type.

In operation, the container open end C" engages and is rotated by the slide roll 19. The eccentric roll 24 is then rotated into engagement with a part of the inside surface of the container side wall C' located inwardly adjacent the open end C". With reference to FIGS. 2A–2E, the external forming roll 11 then begins to move radially inward into contact with the container side wall C' spanning the gap respectively formed between the conical faces 19*a*,24*e* of the slide and eccentric rolls 19,24. More specifically, the side wall C' of the spinning container body C is initially a straight cylindrical section of generally uniform diameter and thickness which may extend from a pre-neck (not shown) previously formed in the container side wall such as by static die necking. As the external forming roll 11 engages the container side wall C', it commences to penetrate the gap between the fixed internal eccentric roll 24 and the axially movable slide roll 19, forming a truncated cone (FIG. 2B). The side wall of the cone increases in length as does the height of the cone as the external forming roll chamfer 11*c* continues to squeeze or press the container metal along the complemental slope or truncated cone 24*e* of the eccentric roll 24 as depicted in FIG. 2C. The cone continues to be generated as the external forming roll 11 advances radially inwardly (the slide roll 19 continues to retract axially as a result of direct pushing contact from roll 11 through the metal) until a reduced diameter 124 is achieved as depicted in FIGS. 2C and 2D. As the cone is being formed, the necked-in portion 124 or throat of the container C conforms to the shape of the forming portion of the forming roll 11. The rim portions 123 of the neck which extend radially outwardly from the necked-in portion 124 are being formed by the complemental tapers 11*b*,19*a* of the forming roll 11 and the slide roll 19 to complete the necked-in portion.

A plurality of spin flow necking tooling assemblies embodying the above-identified tooling, or the improvements according to the present invention described hereinbelow, may be incorporated in a multistation spin flow necking machine of a type disclosed in patent application Ser. No. 929,932 being filed concurrently herewith and commonly assigned, entitled "Spin Flow Necking Apparatus and Method of Handling Cans Therein" incorporated by reference herein it its entirety.

The above-described spin flow necking process, while producing a large diameter reduction in the open end of the container C (e.g., 0.350"), has various drawbacks when applied to two-piece aluminum can manufacture. One drawback, for example, is grooving of the neck at the initial point of contact between rolls 11,19 in FIG. 2B which occurs on the inside of the container as a result of the small radii on the forming roll pushing past and against the small radii on the slide roll as the forming roll moves radially inwardly and axially rearwardly during the necking process along the chamfer 24*e* of the eccentric roll. Due to the spring force 20 urging the slide roll 19 toward the eccentric roll 24, the metal caught between these colliding radii which are forcefully pressed together under spring bias, actually results in the grooving phenomenon on both the inner and outer surfaces of the neck. On the inside surface, this grooving results in metal exposure (i.e., wearing away of the protective coating) which often allows the beverage to "eat through" the container side wall C'. It has also been discovered that such grooving often results in actual cutting of the metal as the form roll 11 is radially inwardly advanced from the position depicted in FIG. 2B to that of FIG. 2C.

As the form roll 11 moves into its radially inwardmost position depicted in FIG. 2E, the spring pressure acting against the slide roll 19 in the direction of the forming roll disadvantageously results in pinching of the end of the flange-like portion 123 and undesirable thinning of the metal. In some cases, particularly when necking a can to smaller diameters (e.g., 204 or 202), the edge is sometimes thinned down to a knife edge.

It is accordingly an object of the present invention to prevent grooving of the container side wall or neck during the spin flow necking process.

Another object is to control the interaction of the outer form roll with the inner slide roll to ensure that the form roll acts directly on the metal at appropriate instances while preventing excessive interaction which may result in grooving.

Still a further object is to prevent excessive thinning of the flange type edge by preventing excessive force from being applied to the edge by the form and slide rolls.

Yet another object is to increase the spring force initially urging the slide roll towards the eccentric roll to allow a snug fit to occur between the container open end and the slide roll outer surface for improved support of the container open end on the slide roll during spin flow necking.

DISCLOSURE OF THE INVENTION

An apparatus for necking-in an open end of a container body comprises a first member and a second member mounted for engaging the open end of the container side wall along an inner surface thereof.

Means is provided for rotating the container body and externally located means moves radially inward into deforming contact with an outside surface of the container side wall in a region thereof overlying an interface between the first and second members. Such contact between the externally located means with the side wall causes the contacted wall portion to move radially inwardly into a gap formed at the interface, caused by axial separation of the first and second members under the action of the radially inward advancing movement of the externally located means into the gap to thereby neck-in the side wall. In accordance with the invention, means, controlled by sensing radially inward movement of the externally located means, is provided for initiating gradual axial separation between the first and second members before the externally located means acts directly on both the first and second members through the contacted portion.

In the preferred embodiment, the first member is a slide roll engaging and supporting the inside of the container open end. The slide roll is mounted for driven rotary motion about, and axial movement along, the container axis. The slide roll is resiliently biased into the container open end. The second member is an axially fixed roll mounted in axially inwardly spaced relation to the slide roll for engagement with an inside surface of the container side wall. The second roll has a conical end surface which faces the open end of the container and the slide roll includes a conical end surface facing the conical end surface of the axially fixed roll in opposite inclination thereto. The externally located means is a form roll having a peripheral deforming nose positioned externally of the container side wall and mounted for free rotary and controlled radial movement towards and away from the container. The form roll is biased for axial movement along an axis parallel to the container axis. The form roll deforming nose includes first and second oppositely inclined conical surfaces which are respectively opposed to the conical surfaces on the second roll and slide roll.

The control means includes a cam follower surface mounted to contact one of the conical surfaces on the form roll during radial inward advancing movement thereof as the form roll initially contacts the conical surface on the second roll through the container side wall and before the form roll contacts the conical surface on the slide roll. Such contact between the form roll with the cam follower surface causes the slide roll to begin to axially move away from the second roll to thereby prevent pinching of the container side wall between the form and slide rolls.

Such control means preferably includes a cam ring mounted to the slide roll radially outwardly adjacent therefrom. The cam follower surface is a conical surface which is located radially outwardly adjacent the conical surface of the slide roll and is disposed in a plane which is spaced closer to the opposing conical surface on the form roll, relative to the plane of the conical surface on the slide roll, by a distance slightly greater than the undeformed thickness of the container side wall.

The cam follower surface and the conical surface of the form roll facing the cam follower surface are further arranged to produce the following motions:

i) the form roll initially contacts the cam follower surface as it advances radially inwardly and toward the slide roll, via sliding contact with the conical surface of the second roll, so that the cam ring begins to axially move the slide roll away from the form roll to prevent pinching of the container side wall between the form and slide rolls;

ii) as the form roll continues to radially inwardly advance it puts slight pressure on the container side wall extending between it and the slide roll so that the form roll is now pushing the slide roll directly through the container side wall and not through contact with the cam follower surface; and iii) further radially inward movement of the form roll causes it to re-contact the cam follower surface and thereby control the amount of clamping force and squeezing of the edge of the container side wall now extending between the form and slide rolls to prevent excessive spinning thereof.

An annular clearance gap is formed between the conical surfaces of the slide roll and cam ring to receive the container side wall open end which is supported on the slide roll during necking.

The slide roll and cam ring may also be of unitary construction. Preferably, however, these are separate members to enable the slide roll to be made of carbide to provide proper tooling surfaces while the cam ring is made of hardened tool steel.

A method of spin flow necking-in an open end of a cylindrical container body is also disclosed. The method comprises the steps of positioning inside the container body an axially fixed roll engageable with the inside surface of the container body. The axially fixed roll has a sloped end surface which faces the open end of the container body. A slide roll is also positioned inside the container body which fits the inside diameter of the open end to support same. The slide roll has an end facing the sloped end surface of the axially fixed roll. The slide roll is supported for axial displacement away from the axially fixed roll. The slide roll end and the sloped end surface of the axially fixed roll define a gap therebetween. An outer form roll is positioned opposite the gap radially outwardly from the container body for axial displacement away from the axially fixed roll during contact with the sloped end of same. The form roll has a trailing end portion and a peripheral forming portion. As the container body spins, the form roll is advanced radially inwardly relative to the gap so that the trailing end portion presented by the roll and the sloped end surface of the axially fixed roll engage the container body between them while the trailing end portion of the form roll moves inwardly along the sloped end surface of the axially fixed roll to roll a neck into the container body. As the body continues to spin while the form roll moves inwardly, the slide roll is retracted axially until the roller has spun an outwardly extending portion on the end portion of the container body engaged between the slide roll and the roller. In accordance with the method of the invention, the axial retracting movement of the slide roll is controlled by contact between a surface of the form roll with a cam follower surface.

The form roll has conical surfaces which are respectively engageable with the sloped end surface on the axially fixed roll and another sloped end surface on the slide roll. These form roll conical surfaces are smoothly connected with a curved forming surface extending therebetween and defined by a pair of small radii. The sloped end of the slide roll is also smoothly connected through another small radius to the axially extending surface thereof which is engageable with the inside surface of the container body. The cam follower surface operates to axially retract the holder as the small radius on the form roll approaches the small radius on the slide roll to thereby prevent pinching of the container side wall between these two small radii by allowing the radii to approach each other while maintaining separation therebetween by a distance slightly greater than the original thickness of the container side wall.

Continued radially inward forming movement past a predetermined point at which the metal of the container side wall between the slide roll and the conical surface of the form roll has thickened will result in the form roll putting slight pressure directly on the metal. A gap opens between the form roll and cam follower surface so that the form roll is now pushing the slide roll directly through the metal and not through the cam follower surface. As the outermost end of the container side wall moves between the form roll and the slide roll, the form roll will once again contact the cam follower surface so that the rolling contact between the form roll and the slide roll does not excessively thin the edge of the open end.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1:
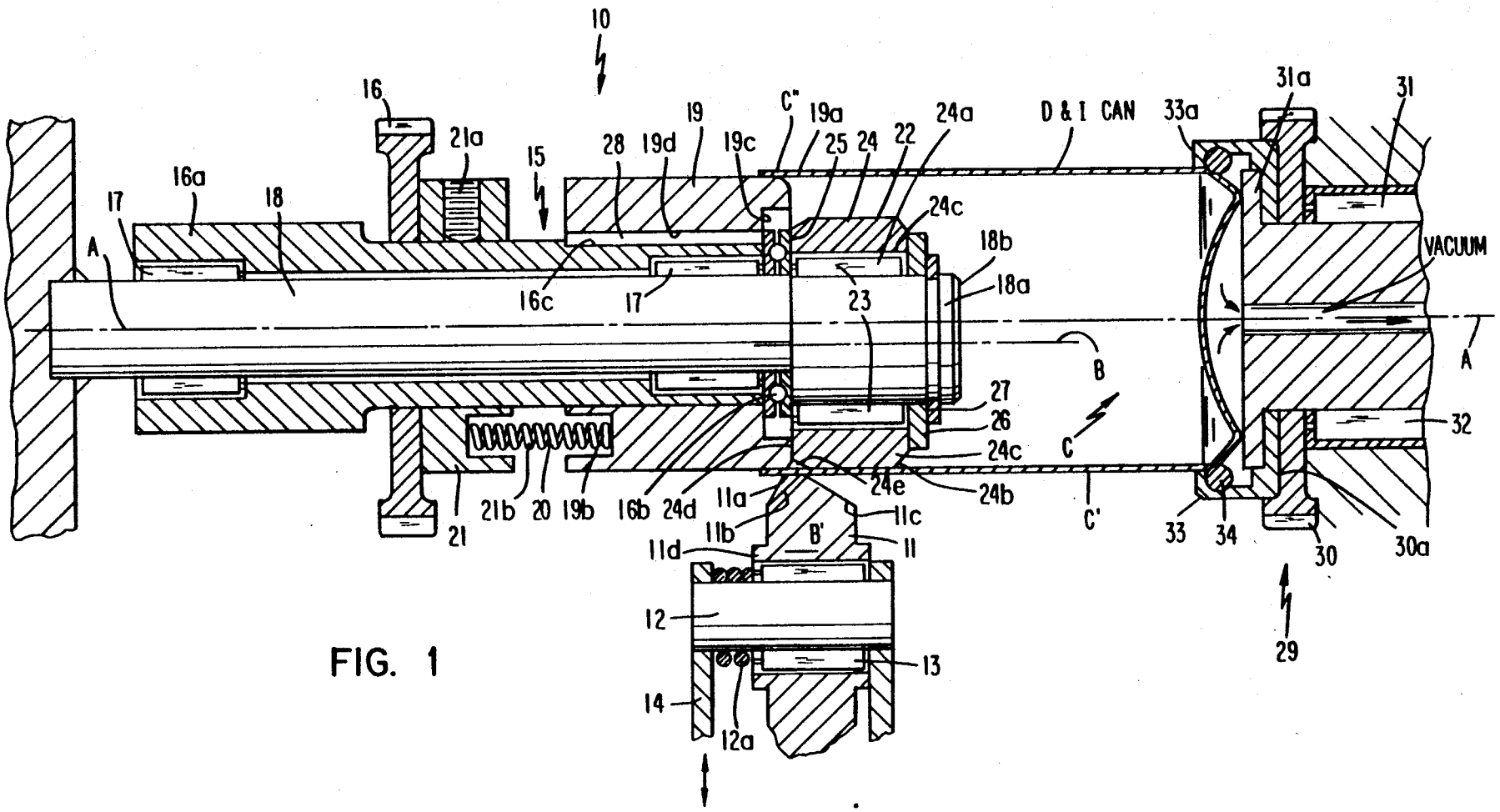
FIG. 1 is a cross-sectional view of a prior spin flow necking process.
Figure 2A:
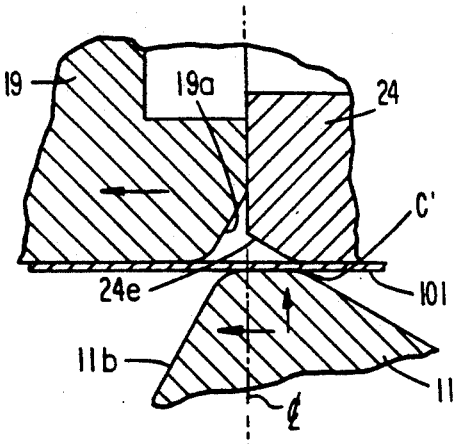
FIGS. 2A–2E are enlarged, cross-sectional sequential views depicting the spin flow necking forming sequence with the tooling of FIG. 1.
Figure 2B:
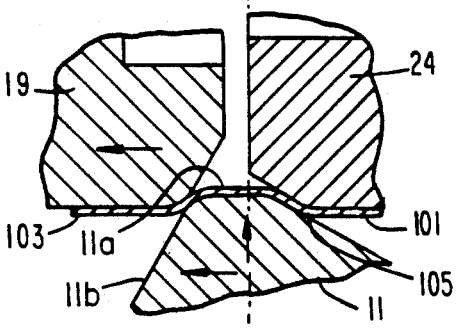
Figure 2C:
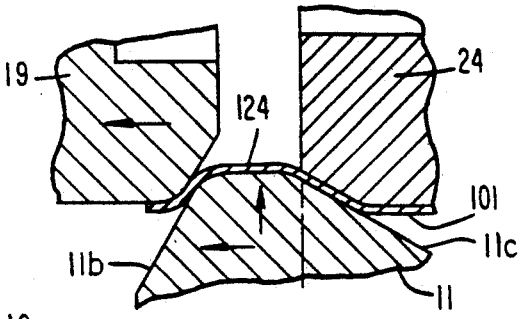
Figure 2D:
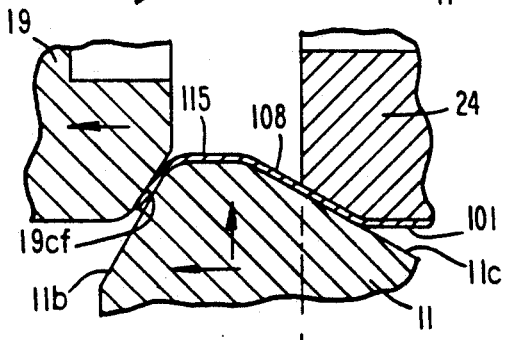
Figure 2E:
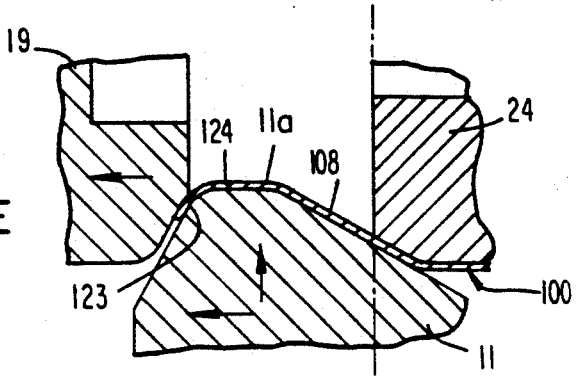
Figure 3:
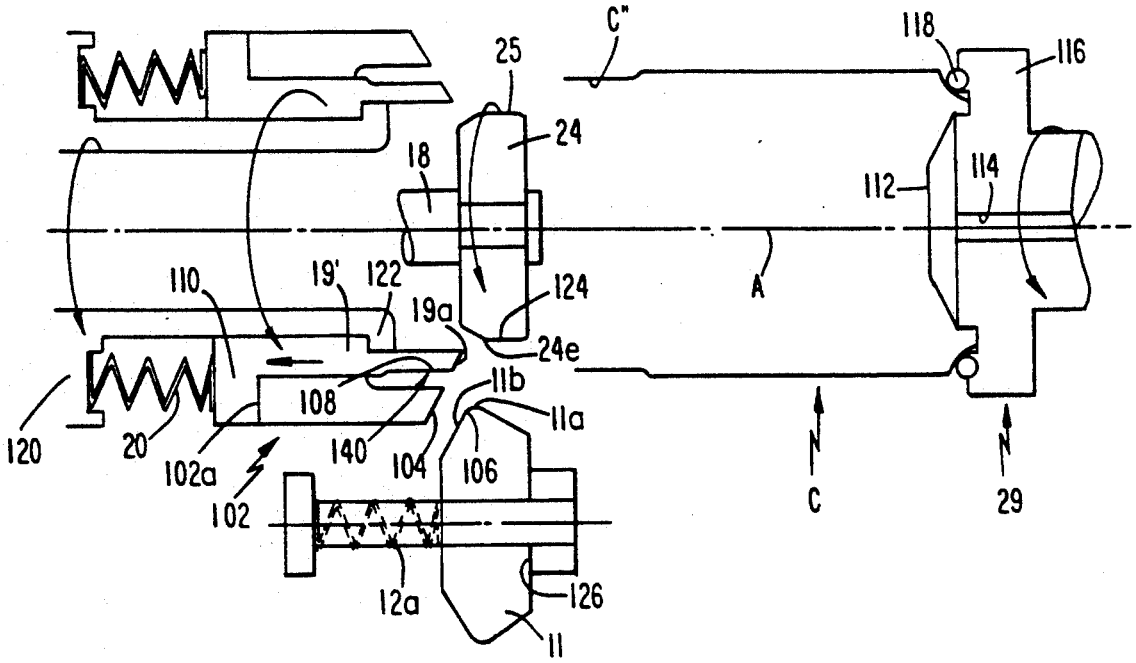
FIG. 3 is a schematic representation of an improved spin flow necking apparatus in accordance with the present invention.

FIG. 3 is a schematic illustration of a spin flow necking assembly in accordance with the present invention. Therein, the functional components are substantially identical to the tooling components described in connection with FIG. 1, supra, except as noted hereinbelow.

Spin flow necking assembly 100, as schematically depicted in FIG. 3, includes a cam ring 102 in the form of a cylindrical member having a conical face 104 extending at the same angle as the conical forming surface 19*a* on the slide roll 19' in spaced, radially outward adjacent relationship, such that the conical face or cam follower surface 104 contacts the conical lead portion 11*b* of the form roll 11 before the small radius 106 between this lead surface and the forming surface 11*a* on the form roll exert force on the metal wrapped around the corresponding small radius 108 of the slide roll 19' in the manner discussed more fully below. Therefore, the cam follower surface 104 on the cam ring 102 is disposed in a plane P parallel to the plane P' of the slide roll chamfer 19*a* (FIG. 5 only) and is spaced forwardly therefrom by approximately the initial metal thickness. The cam ring 102 is fastened to the slide roll 19' and rotates and moves with it. In the preferred embodiment of FIG. 3, rearward axial displacement of the cam ring 102 is transmitted to the slide roll 19' by the form roll 11 via nesting engagement of the rear face 102*a* of the cam ring against an annular mounting flange 110 projecting radially outwardly from the rear portion of the slide roll.

The construction and operation of the cam controlled interaction between the form roll 11 and slide roll 19' is best understood through a sequential description of the spin flow necking process. Initially, with reference to FIG. 3, the container bottom 112 is loaded onto the base pad assembly 29 which retains the container C by vacuum applied in a known manner through a central hole 114. The container C is located on a raised circular plug 116 inside the countersink diameter of the bottom. An airtight seal is maintained on the outside tapered surface of the container bottom 112 with an elastic seal 118. The base pad assembly 29 is axially movable to advance the container into the tooling for forming and to remove the finished can for transfer to a flanging operation. The base pad assembly 29 dwells at both ends of its motion and has no axial movement during the forming process. The base pad is rotated by a main drive (not shown) and provides most of the rotative force on the container during the forming process. The main drive may also rotate the necking spindle assembly to ensure synchronous co-rotation.

As mentioned above, the slide roll 19' is a cylindrical sleeve with a conical end 19*a* over which the open end C'' of the container is positioned by the movement of the base pad. The slide roll 19' is supported by a rotating mandrel 120 driven by the main drive at the same rotative speed as the base pad assembly, as aforesaid. The slide roll is spring-loaded against a positive stop 122 and is pushed out of the open end of the container C by the form roll 11. The slide roll 19' is also rotated by the driven mandrel 120 upon which it slides.

The eccentric roll 24 is a cylindrical roll which is smaller than the final neck diameter of the container. The working surfaces are the cylindrical outside diameter 25, the conical surface 24*e* and the connecting radius 124. The conical angle of 24e determines the cone angle that is formed on the container.

The form roll 11 is a cylindrical roll with a profiled outside diameter that forms the entire outside surface of the container neck area. It is free to rotate on an axis and is biased against a stop 126 with a light spring 12a. It is free to slide toward the open end of the container C against the light spring pressure. The axis on which it rotates is moved toward the container C to force the form roll 11 into contact with the container. It is free to seek an equilibrium position between the eccentric roll 24 and the cam ring/slide roll assembly.

In FIG. 3, the base pad 29 is in the load position with a container C in place on the pad. The eccentric roll 24 is concentric with the slide roll 19'. The slide roll 19' is against the forward stop 122 and the form roll assembly is in the 'out' position.

Figure 4:
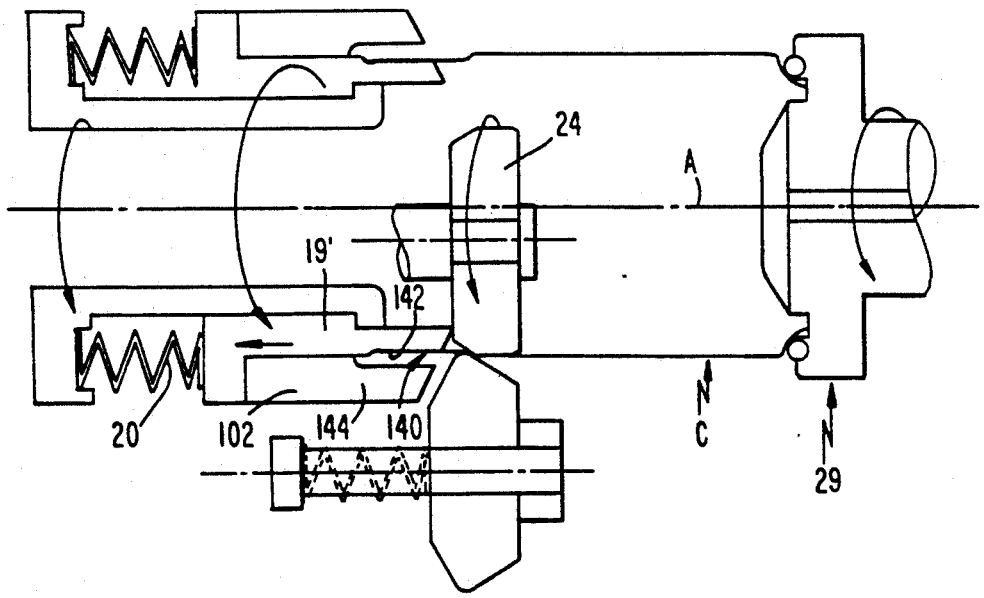
FIG. 4 is a schematic representation similar to FIG. 3 depicting the form roll radially inwardly moved into initial contact with the container side wall to be necked.

With reference to FIG. 4, the base pad assembly 29 has moved the container C onto the slide roll 19' and the eccentric roll 24 has rotated to contact the container at the neck location C''. The form roll 11 has moved toward the container C and the form roll radius has contacted the container at the pre-neck location thereon. At this point, the rotating container C has also started both the eccentric roll 24 and form roll 11 to rotate.

Figure 5:
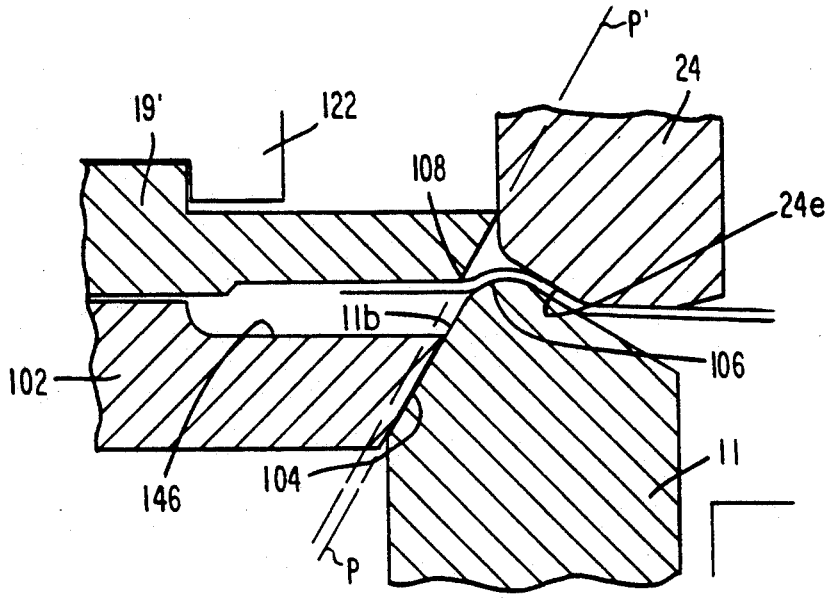
FIG. 5 is an enlarged, detailed sequential view depicting the relative locations of the tooling components at the onset of necking.

In FIG. 5, the form roll axis has moved radially inwardly closer to the container axis and has started to form the neck. The conical surface 24e on the eccentric roll 24 has forced the form roll 11 toward the open end C'' of the container C. The form roll 11 has just touched the cam follower surface 104. The small radius 106 on the form roll 11 is very close to the small radius 108 on the slide roll 19' but does not pinch the metal between these two points. This is because the cam ring follower surface 104 is positioned so these radii 106,108 may approach each other but stay separated by a distance slightly greater than the initial side wall thickness. This is presently understood to be a key feature in the elimination of metal exposure and neck cracks caused by excessive contact pressure between the two small radii 106,108 in the uncontrolled collison of the form roll 11 with the metal wrapped around the small radii 108 on the slide roll 19 in the prior spin flow necking process described hereinabove. In other words, since the form roll 11 contacts the cam follower surface 104 as the two radii 106,108 approach, such contact results in retraction or rearward axial sliding movement of the slide roll 19' which permits the two radii to move past each other.

Figure 6:
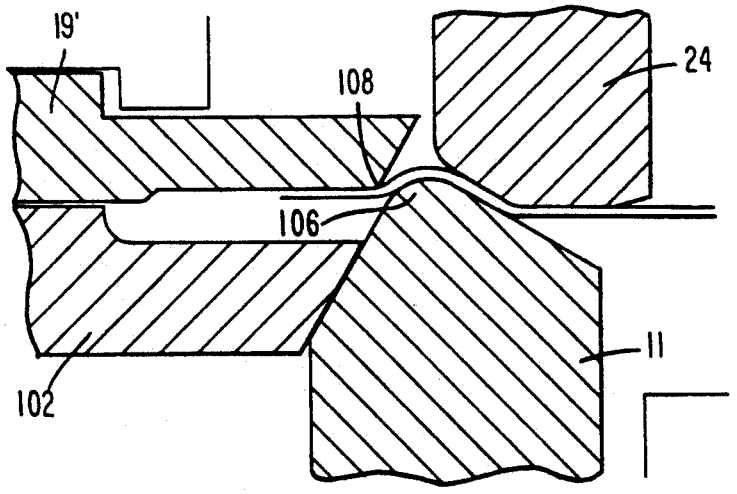
FIG. 6 is a view similar to FIG. 5 sequentially depicting further relative positioning of the tooling components as necking continues.

In FIG. 6, the form roll 11 has penetrated further between the eccentric roll 24 and the slide roll 19'. The small radius 106 on the form roll 11 is just passing the small radius 108 on the slide roll 19'. The rolls 11,19' do not pinch the metal but have moved closer. As mentioned above, the form roll 11 is forcing the slide roll 19' back by contact between the form roll and the cam ring 102 instead of contact at this point between the form roll and the slide roll as occurred in the aforesaid prior spin flow necking process.

Figure 7:
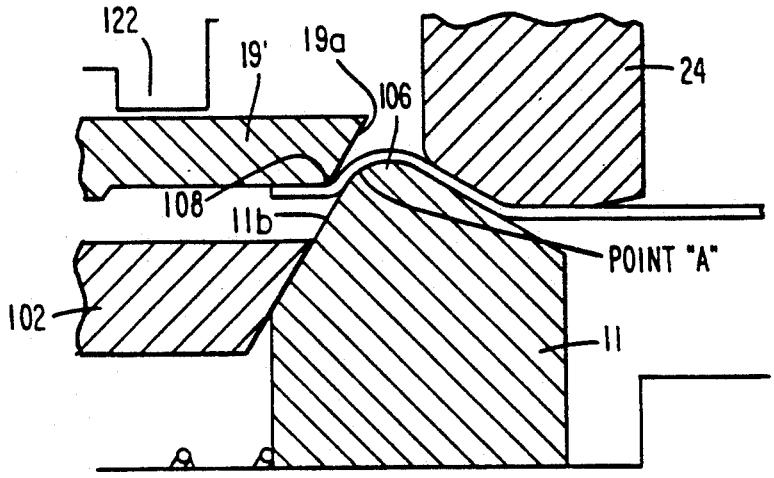
FIG. 7 is similar to FIG. 6 depicting further sequential positioning of components.

In FIG. 7, the form roll 11 has continued its penetration and the small radius 106 is past the small radius 108 on the slide roll 19' (point A). At this point, the conical surfaces 19a,11b on the slide roll and the form roll, respectively, are opposite and parallel each other. The slide roll 19' and cam ring 102' have been pushed to the left in FIG. 7. The combination of the metal thickening as a result of being squeezed between the form roll 11 and the eccentric roll 24 as the metal wraps around the forming surface 11a of the form roll, and the shape of the left or trailing conical surface 11b on the form roll, has reduced the relative clearance between the form roll and the slide roll so that the form roll is now actually putting slight pressure on the metal.

Figure 8:
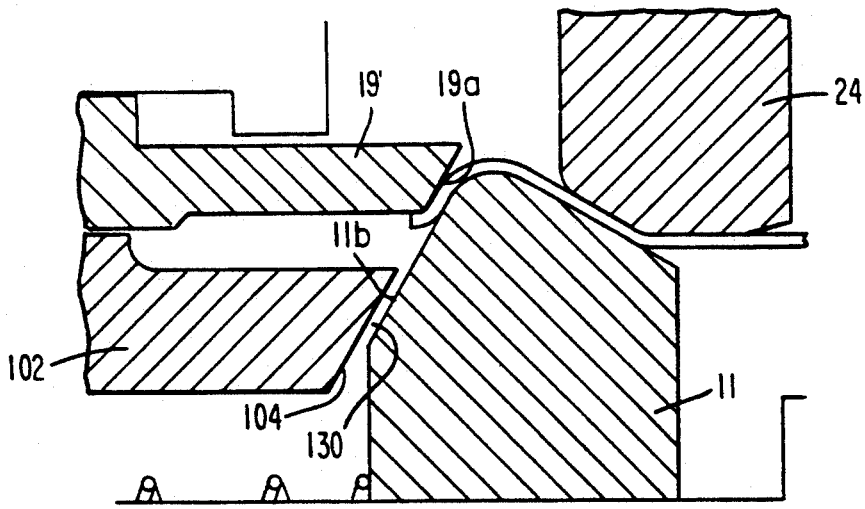
FIG. 8 is a view similar to FIG. 7 depicting still further sequential positioning.

In FIG. 8, the form roll 11 has now penetrated further into the gap between the eccentric and slide rolls 24,19'. The form roll 11 is clearly clamping the metal between it and the slide roll 19' and, as a result, a gap 130 has opened up between the form roll surface 11b and the cam ring follower surface 104. The form roll 11 is now pushing the slide roll 19' directly in the axially rearward direction through its contact with the metal, and not through the cam ring 102. Since the small radii 106,108 between the form roll 11 and slide roll 19' have already "slipped" past each other without undesirable grooving of the metal therebetween, the direct interaction of the form roll in thinning and shaping the metal against the bias of the conical surface 19a on the slide roll is important to ensure proper necking and distribution of metal.

Figure 9:
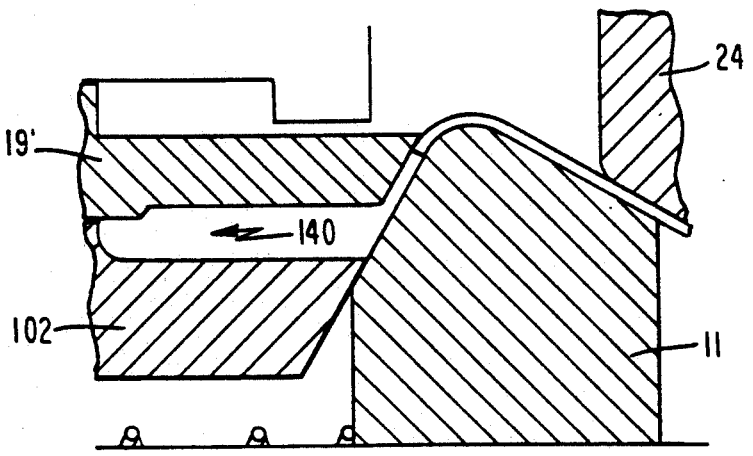
FIG. 9 is similar to FIG. 8 depicting the locations of the tooling components at the radially most inward position of the form roll.

In FIG. 9, the form roll 11 has now penetrated to its radially inwardmost position to complete the formation of the spin flow neck. During the entire forming process, between 20 to 24 revolutions of the container C are required, depending on the diameter, thickness and the amount of diameter reduction in the container end. The rolling contact between the form roll 11 and the slide roll 19' has thinned the edge of the flange slightly. Therefore, in accordance with a further feature of this invention, the form roll 11 now once again contacts the cam ring 102 to prevent further thinning of the flange area of the container C, i.e., gap 130 has closed.

Figure 10:
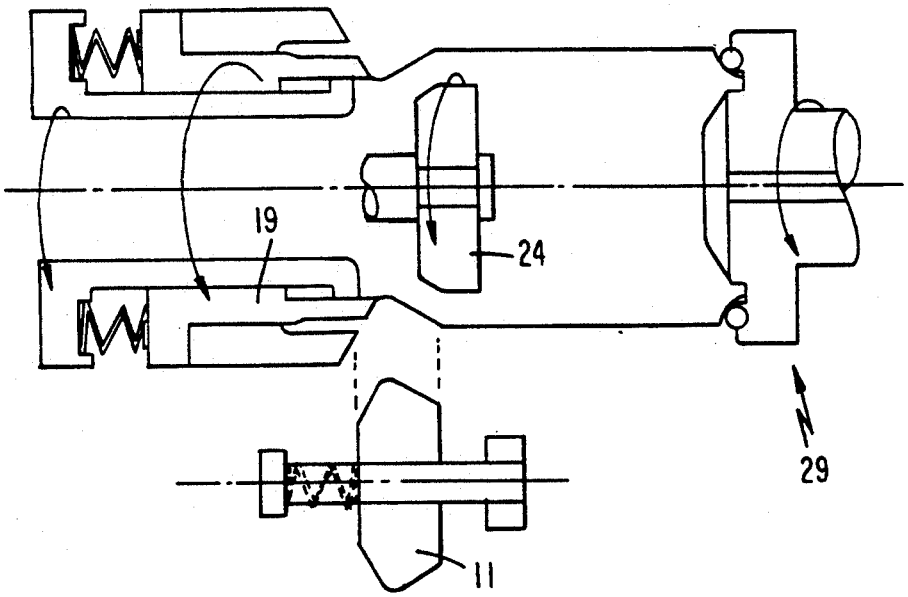
FIG. 10 is a schematic representation depicting the locations of the components after necking.

In FIG. 10, as the base pad 29 begins to pull the container C back from the tooling, the eccentric roll 24 has moved to its concentric position and the form roll 11 has moved radially outward to clear the neck profile. The base pad 29 then moves back to its original load-unload position (FIG. 11) to be ready for the transfer wheel (not shown) to pick up the necked-in container and insert it into the flanging turret (not shown).

From the foregoing description, it will be appreciated that the slide roll 19' and cam ring 102 may be of unitary construction with an annular gap 140 between the slide roll forming surface 19a and the cam ring follower surface 104 to initially receive the container open end C'' which must engage the rearwardly extending axial surface 142 of the slide roll before necking begins (FIG. 4). Since the form roll 11 engages the container C only at one side, it will be appreciated that the container open C'' end tends to be deformed into an oval shape when viewed in cross section in a direction parallel to the container longitudinal axis A. Therefore, it is important that the annular gap 140 between the forward end portion 144 of the cam ring 102 and slide roll 19' be sufficiently wide in the radial direction to prevent the container open end from contacting the rearwardly axially extending inner surface 146 (FIG. 5 only) of the cam ring which may cause the metal of the container to split. In practice, the groove is approximately 0.080" wide.

Although the slide roll 19' and cam ring 102 may be of unitary construction, as aforesaid, it is preferred to form these elements as separate components in accordance with the preferred embodiment since the slide roll is preferably carbide metal while the cam ring is tool steel. As a practical matter, forming the cam ring and slide roll from carbide metal so as to be of unitary construction is not feasible since it is very difficult to machine the annular clearance gap 140 between the slide roll forming surface 19*a* and the cam ring follower surface 104 as aforesaid.

Another advantage achieved with the cam ring 102 of the present invention is the ability to utilize a heavier spring 20 urging the slide roll 19' into its initial, axially forward position, in comparison with the initial spring force in the prior spin flow necking process. In the prior process, the initial spring force could not exceed 5 pounds since the greater the spring force, the more extensive the grooving will be. On the other hand, a greater spring force is desirable since the snugger the fit between the slide roll 19' and container open end C", the greater the control will be over the final neck diameter. With the cam ring 102 of the present invention, since grooving is no longer a problem, the spring pressure may be greater. In the preferred embodiment, the spring pressure is preferably now 5–8 pounds.

Figure 11:
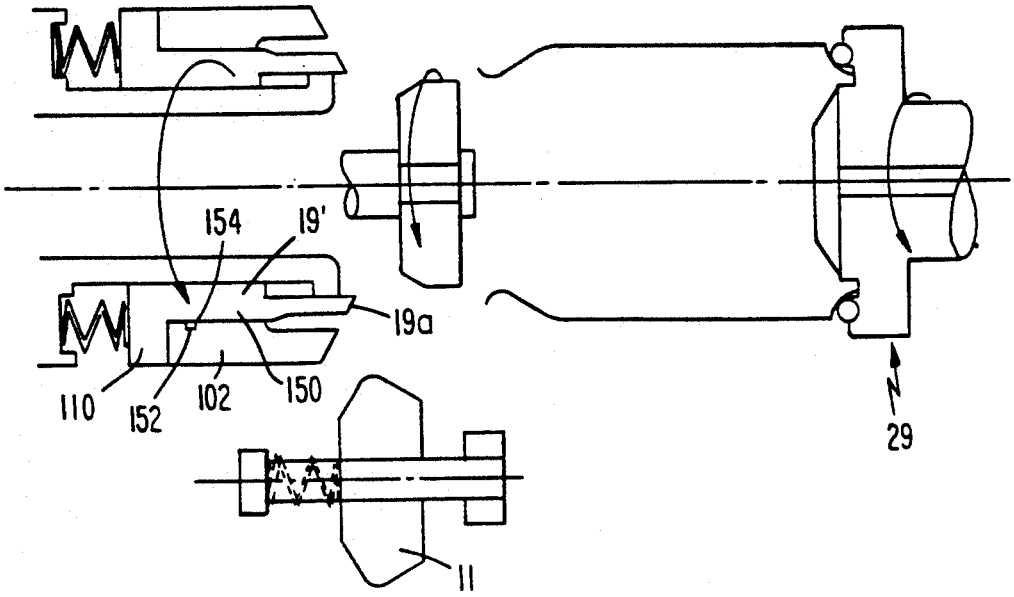
FIG. 11 is similar to FIG. 10 after the base pad pulls the container back from the tooling for unloading (loading).

In the preferred embodiment, the inner cylindrical surface 150 of the cam ring 102 is formed with an annular groove adopted to receive an O-ring 152 as best depicted in FIG. 11 only. This O-ring 152 is engageable with an annular groove 154 formed in the outer cylindrical surface of the slide roll 19' located between the mounting flange 110 and the forming surface 19*a*. The O-ring 152 prevents any relative axial sliding movement from occurring between the cam ring 102 and the slide roll 19'. In the alternative, the cam ring 102 and slide roll 19' may be screwed or bolted together.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

We claim:

1. Apparatus for necking-in an open end of a side wall of a container body, comprising:

a) a first member and a second member mounted for engaging inside surfaces of the container side wall defining said open end;

b) means for rotating said container body;

c) externally located means mounted for radially inward movement into deforming contact with an outside surface of said container side wall in a region thereof overlying an interface between said first and second members, whereby contact between said externally located means with said side wall causes the contacted wall portion to move radially inwardly into a gap formed at the interface caused by axial separation of said first and second members under the action of the radially inward advancing movement of the externally located means into the gap to thereby neck-in said side wall; and d) means, controlled by sensing radially inward movement of the externally located means, for initiating gradual axial separation of said first and second members before said externally located means acts directly on both said first and second members through the contacted portion.

2. Apparatus of claim 1, wherein said first member is a slide roll engaging the inside of the container side wall open end and mounted for driven rotary motion about, and axial movement along, the container axis, and including resilient means for biasing said slide roll into the container open end;

said second member is an axially fixed second roll mounted in axially inwardly spaced relation to the slide roll for engagement with an inside surface of the container side wall, said second roll having a conical end surface which faces the open end of the container and said slide roll including a conical end surface facing the conical end surface of the second roll, said conical surfaces extending in opposite inclinations to each other;

said externally located means is a form roll having a peripheral deforming nose positioned externally of the container side wall and mounted for free rotary and controlled radial movement towards and away from the side wall, said form roll being biased for axial movement along an axis parallel to the container axis, said form roll deforming nose including first and second oppositely inclined conical surfaces which are respectively opposed to the conical surface on the second roll and the conical surface on the slide roll.

3. Apparatus of claim 2, wherein said control means includes a cam follower surface mounted to contact one of the conical surfaces on the form roll during radially inward advancing movement thereof as the form roll initially contacts the conical surface on the second roll through the container side wall and before the form roll contacts the conical surface on the slide roll, whereby said contact between the form roll with the cam follower surface causes the slide roll to begin to move axially away from the second roll to thereby prevent pinching of the container side wall between the form roll and slide roll.

4. Apparatus of claim 3, wherein said control means includes a cam ring mounted to the slide roll radially outwardly adjacent therefrom, wherein said cam follower surface is a conical surface on the cam ring which is located radially outwardly adjacent the conical surface of the slide roll and is disposed in a plane which is spaced closer to the opposing conical surface on the form roll, relative to the plane of the conical surface on the slide roll, by a distance slightly greater than the undeformed thickness of the container side wall.

5. Apparatus of claim 4, further comprising an annular gap formed between the conical surfaces of the slide roll and cam ring to receive the container side wall open end which is supported on the slide roll during necking.

6. Apparatus of claim 5, wherein said slide roll and said cam ring are of unitary construction.

7. Apparatus of claim 3, wherein said cam follower surface and the conical surface of the form roll facing the cam follower surface are arranged to produce the following motions:

i) the form roll initially contacts the cam follower surface as it advances radially inwardly and toward the slide roll via sliding contact with the conical surface of the second roll so that the cam ring begins to axially move the slide roll away from the form roll and thereby the container side wall is not pinched between the form and slide rolls;

ii) as the form roll continues to radially inwardly advance it puts slight pressure on a thickened portion of the container side wall extending between it and the slide roll so that the form roll is now pushing the slide roll directly through the container side wall and not through contact with the cam follower surface; and iii) further radially inward movement of the form roll causes it to re-contact the cam follower surface and thereby control the amount of clamping force and squeezing of the edge of the container side wall now extending between the form and slide rolls to prevent excessive thinning thereof.

8. A method of spin flow necking-in an open end of a cylindrical container body, comprising the steps of:

a) positioning inside the container body, in axial inwardly spaced relation from the open end thereof, an axially fixed roll engageable with an inside surface of the container body, said axially fixed roll having a sloped end surface which faces the open end;

b) positioning inside the container body a slide roll which fits the inside diameter of the container body to support the same, said slide roll having an end facing the sloped end surface of said axially fixed roll, and said slide roll being supported for axial displacement away from said axially fixed roll, said slide roll end and said sloped end surface of said axially fixed roll defining a gap therebetween;

c) positioning opposite said gap on an outside surface of the container body a roller supported for axial displacement away from said axially fixed roll, said roller having a trailing end portion and a peripheral portion;

d) spinning the container body thusly supported by said slide roll and advancing said roller radially inwardly relative to said gap so that said trailing end portion presented by the roller and said sloped end surface of said axially fixed roll engage a container body between them while said trailing end portion of said roller moves inwardly along said sloped end surface of said axially fixed roll to roll a neck into the container body; and e) continuing to spin the container body while the roller moves inwardly and the slide roll retracts axially until the roller has spun an outwardly extending portion on the end portion of the container body engaged between said slide roll and said roller;

wherein the axial retracting movement of the slide roll is controlled by contact between a surface of the roller with a cam follower surface controlling such axial retraction of said slide roll.

9. The method of claim 8, wherein the forming roller has conical surfaces which are respectively engageable with the sloped end surface on the axially fixed roll and another sloped end surface on the slide roll end defining said gap, said form roller conical surfaces being smoothly connected with a curved forming surface extending therebetween and defined by a pair of small radii, and the sloped end of the slide roll is smoothly connected to the axially extending surface thereof engageable with said inside surface of the container body by means of another small radius portion, and wherein said cam follower surface operates to axially retract the slide roll as the small radius on the form roller approaches the small radius on the slide roll to thereby prevent pinching of the container side wall between these two small radii by enabling said radii to approach each other while maintaining separation therebetween by a distance slightly greater than the original thickness of the container side wall.

10. The method of claim 9, wherein continued radially inward forming movement, past a predetermined point at which the metal of the container side wall between the slide roll and conical surface of the form roller has thickened, results in the form roller putting slight pressure directly on the metal with a gap opening up between the form roller and the cam follower surface so that the form roller is now pushing the slide roll by acting through the metal and not through the cam follower surface.

11. The method of claim 10, wherein, as the outermost end of the container side wall moves between the form roller and the slide roll, the form roller once again contacts the cam follower surface so that the rolling contact between the form roll and the slide roll does not excessively thin the edge of the open end.

12. The method of claim 10, wherein the entire forming process requires approximately 20–24 revolutions of the container.

* * * * *